US007494079B1

(12) United States Patent
Siracusa

(10) Patent No.: US 7,494,079 B1
(45) Date of Patent: Feb. 24, 2009

(54) REFUSE RECYCLING PLANT

(76) Inventor: Gianni Siracusa, 100 Mary Way, Los Gatos, CA (US) 95032

( * ) Notice: Subject to any disclaimer, the term of this patent is extended or adjusted under 35 U.S.C. 154(b) by 0 days.

(21) Appl. No.: 11/998,662

(22) Filed: Nov. 30, 2007

(51) Int. Cl.
*B02C 21/00* (2006.01)

(52) U.S. Cl. ..... 241/65; 110/220; 110/222; 110/235; 241/79; 241/79.1; 241/101.2; 241/DIG. 38

(58) Field of Classification Search ..... 110/220, 110/222, 235; 241/65, 101.2, 79, 79.1, DIG. 38
See application file for complete search history.

(56) References Cited

U.S. PATENT DOCUMENTS

| | | | | |
|---|---|---|---|---|
| 3,357,380 A | | 12/1967 | Siracusa | |
| 3,473,494 A | | 10/1969 | Siracusa | |
| 3,584,587 A | | 6/1971 | Siracusa | |
| 4,308,809 A | * | 1/1982 | Woods | 110/346 |
| 4,750,437 A | * | 6/1988 | Rouse | 110/346 |
| 5,069,147 A | * | 12/1991 | Tan et al. | 110/349 |
| 6,136,590 A | * | 10/2000 | Kruse | 435/262 |
| 6,692,669 B2 | * | 2/2004 | Mischo | 264/115 |
| 2002/0023860 A1 | * | 2/2002 | Rabiei | 209/3 |

* cited by examiner

*Primary Examiner*—Mark Rosenbaum
(74) *Attorney, Agent, or Firm*—Robert Charles Hill

(57) ABSTRACT

A recycling plant comprises a main conveyor that rotates horizontally near ground level. Collected mixed refuse is brought in by trucks on a driveway surrounding the main conveyer. Loaders or dozers are used to move the refuse onto the main conveyer where it will enter a processing unit straddling the main conveyer. Two or more such processing units can be positioned around the circle formed by the main conveyer. An adjustable height conveyer rides on top of the heaps of refuse entering on the main conveyor and compresses the mass so it can enter a first grinding mill. The refuse is ground and torn into small pieces. A second grinding mill further reduces the size of the pieces. A magnetic pickup uses electromagnets to levitate out bits of iron and steel which are carried away and put in a salvage bin. A manual sorting and picking station with takeaway conveyors and salvage bins allows personnel to manually pick paper, plastic, and glass for recycling. A third grinding mill reduces the remainders to particle suitable for incineration. A vacuum sweeper lifts these particles up and through a flue to a surge bin. A screw feed carries material into a combustion chamber. The combustion products precipitate slag which is carried away and gases that move on to a dilution chamber.

8 Claims, 11 Drawing Sheets

500

REFUSE RECYCLING PLANT

BACKGROUND OF THE INVENTION

1. Field of the Invention

The present invention relates to refuse recycling, and more particularly to plants and machinery for the efficient separation and handling of mixed refuse.

2. Description of Related Art

In the past, landfills were the primary waste disposal means. But fewer waste disposal sites, and increasingly stringent environmental regulations concerning air quality, landfills, and groundwater contamination now favor incineration. Incineration reduces and minimizes wastes by oxidizing and decomposing the matter. It has been successfully applied to industrial, municipal, and hazardous wastes that include organic substances that can undergo and sustain thermal degradation.

Incineration technology has been developing to meet tougher environmental standards. Technological advances include increases in efficiency and improvements in emissions control. After incineration, wastes are converted to carbon monoxide, carbon dioxide, water, and ash. Depending on the composition of the initial waste, compounds can be produced that include halogens, metals, nitrogen, and sulfur. The release of such compounds and carbon dioxide are highly regulated. The destruction efficiency for these hazardous wastes must usually be 99.9999%. So incinerators are equipped with afterburners, scrubbers, filtration units, and membranes.

The choice of which incinerator type to employ depends on the wastes' combustibility, and its characterization as liquid, sludge, solid, or gas. The wastes' ignition temperature, flash point, and flammability limits determine the necessary operating temperature, oxygen concentration, and residence time for greatest waste minimization. Common incinerator types include the rotary kiln, fluidized bed, liquid injection, multiple hearth, catalytic combustion, waste-gas flare, and direct-flame.

Rotary kiln, fluidized bed, and liquid injection incinerators can all be operated in an oxygen-starved mode, e.g., pyrolysis. High caloric value wastes, those with a high heat content, are most appropriate for this kind of operation. Multiple hearth incinerators use vertically shaped hearths, and are good for incinerating sewage sludge. They are operated from 1400-1800° F. Catalytic combustion, waste-gas flare and direct flame incinerators are used for burning gases. Catalytic combustors use a catalyst, and are best for low organic concentration wastes. Waste-gas flares are used for non-hazardous waste with high organic content. Direct flame incinerators operate from 1000-1500° F., and are used when the waste gas has particles.

SUMMARY OF THE INVENTION

Briefly, a recycling plant embodiment of the present invention comprises a main conveyor that rotates horizontally near ground level. Collected mixed refuse is brought in by trucks on a driveway surrounding the main conveyer. Loaders or dozers are used to move the refuse onto the main conveyer where it will enter a processing unit straddling the main conveyer. Two or more such processing units can be positioned around the circle formed by the main conveyer. An adjustable height conveyer rides on top of the heaps of refuse entering on the main conveyor and compresses the mass so it can enter a first grinding mill. The refuse is ground and torn into small pieces. A second grinding mill further reduces the size of the pieces. A magnetic pickup uses electromagnets to levitate out bits of iron and steel which are carried away and put in a salvage bin. A manual sorting and picking station with takeaway conveyors and salvage bins allows personnel to manually pick paper, aluminum, plastic, and glass for recycling. A third grinding mill reduces the remainders to particle suitable for incineration. A vacuum sweeper lifts these particles up and through a flue to a surge bin. A screw feed carries material into a combustion chamber. The combustion products precipitate slag which is carried away and gases that move on to a dilution chamber.

An advantage of the present invention is that a recycling plant is provided that efficiently recycles useful materials.

A further advantage of the present invention is a refuse processing system is provided that operates in a full containment building and has a single level.

Another advantage of the present invention is a refuse processing plant is provided that arranges processing units on a circular conveyor so one can back up the other. Either can shut down, and yet the plant can still be kept operating almost normally.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
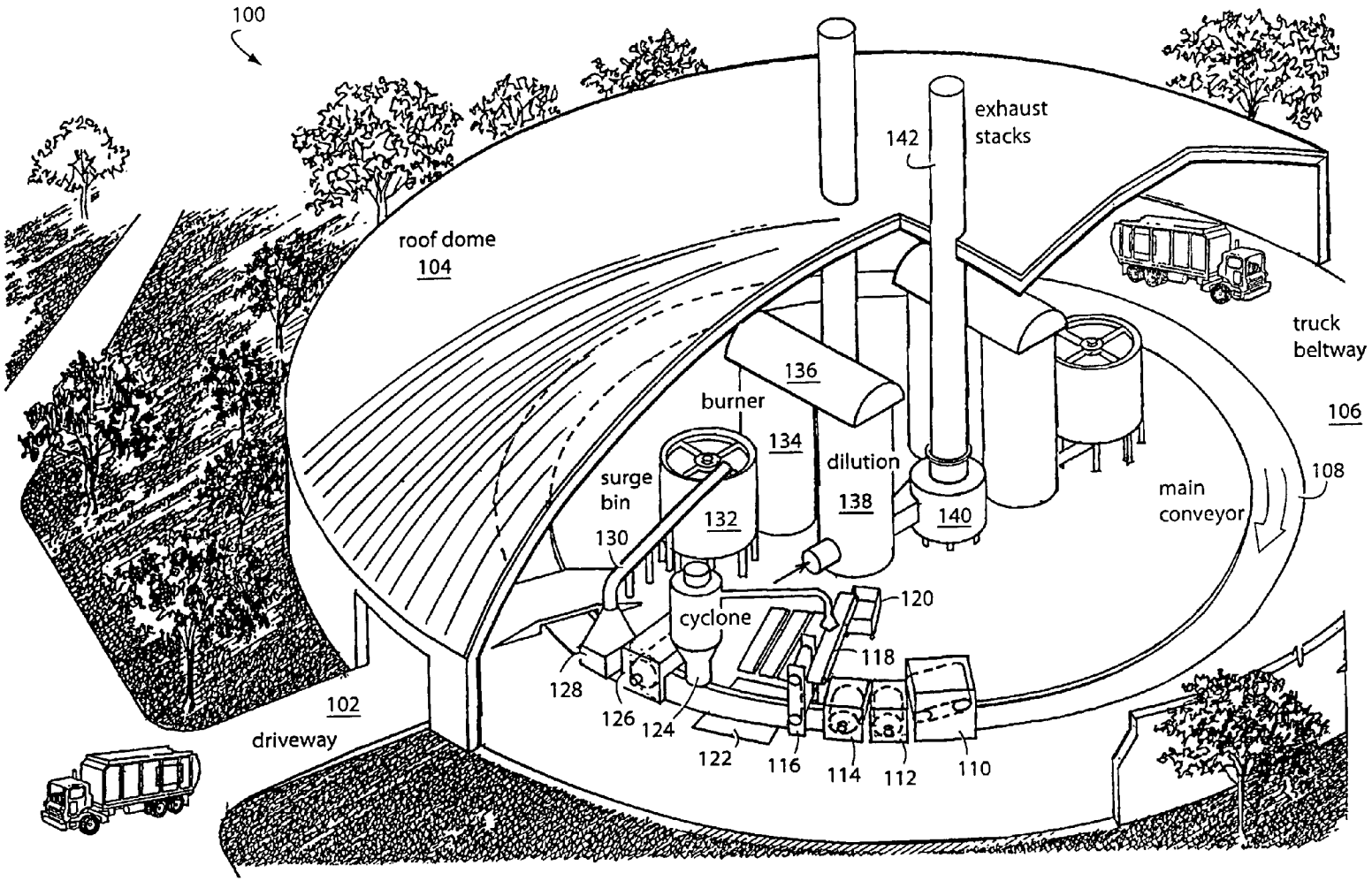
FIG. 1 is a perspective view of a recycling plant embodiment of the present invention in which a single, continuous, planar conveyor circulates around inside a single-level enclosed structure.

FIG. 1 illustrates a recycling plant embodiment of the present invention, referred to herein by the reference numeral 100. The recycling plant 100 comprises an access driveway 102 to a round building with a roof dome 104. Inside, refuse collection trucks can circulate on a truck beltway 106 and deposit collected mixed refuse on a moving main conveyor 108. Two independent processing units are included inside the moving main conveyor 108, and each comprises a feed conveyer 110, a first grinding mill 112, and second grinding mill 114, a magnetic pick up unit 116, a steel/iron takeaway conveyor 118, a steel/iron bin 120, a manual sorting station 122, a cyclone paper vacuum 124, a third grinding mill 126, and a sweeper 128 connected by a flue 130 to a surge bin 132. Both processing units each further include a gas burner 134, a hood 136, an air blower 137, a gas dilution chamber 138, an exhaust gas steam scrubbing condensor 140, and an exhaust stack 142.

The first grinding mill 112 reduces solid materials to 4" size, and the second grinding mill 114 reduces that even further to 2" size pieces. The magnetic pick up unit 116 levitates and carries away iron and steel pieces to conveyor 118. Any paper that was caught is sucked off by cyclone paper vacuum 124 and returned to the main conveyor 108. The third grinding mill 126 reduces the particles down to a size suitable for incineration. Surge bin 132 vacuums these grindings up through flue 130 from sweeper 128. Anything remaining on main conveyor 108 is carried around the loop to the identical second processing unit on the opposite side.

Figure 2:
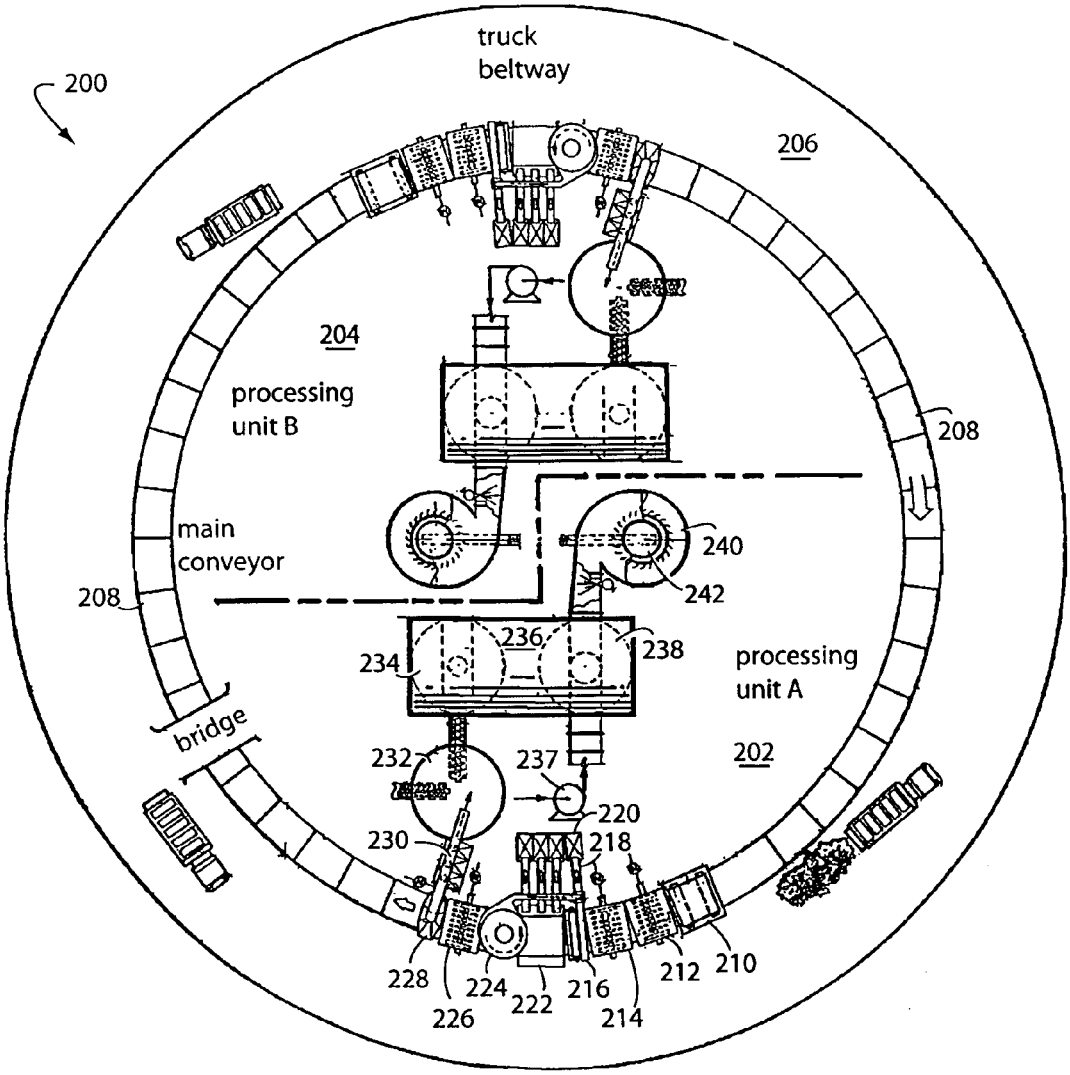
FIG. 2 is a plan view diagram of the interior of a recycling plant embodiment of the present invention in which a single, continuous, planar conveyor circulates around.

FIG. 2 shows a recycling plant embodiment of the present invention from a top, plan view, and is referred to herein by the reference numeral 200. The recycling plant 200 comprises a pair of independent A and B processing units 202 and 204. Refuse collection trucks circulate on a concrete beltway 206 and deposit mixed refuse they collected on their routes. Bulldozers or loaders are typically used to push or scoop the debris onto a clockwise moving main conveyor 208. The two independent processing units 202 and 204 each comprise an input feed leveler conveyer 210, a first grinding mill 212, and second grinding mill 214, a magnetic pick up unit 216, a steel/iron takeaway conveyor 218, a steel/iron bin 220, a manual sorting station 222, a cyclone paper vacuum 224, a third grinding mill 226, and a sweeper 228 connected by a flue 230 to a surge bin 232. Both processing units each further include a gas burner 234, a hood 236, an air blower 237, a gas dilution chamber 238, a condensor 240, and an exhaust stack 242.

Unacceptably large or heavy items placed on the main conveyor 208 are manually removed before entering the input feed leveler conveyer 210. The input feed leveler conveyer 210 rides on top of the material coming in to compress it down against the main conveyor 208 so that it can enter the first grinding mill 212. The input feed leveler conveyer 210 has an adjustable operational height.

As in FIG. 1, the first grinding mill 212 reduces solid materials to 4" size, and the second grinding mill 214 reduces that even further to 2" size pieces. The magnetic pick up unit 216 levitates and carries away iron and steel pieces to conveyor 218. Any paper that was caught up will be sucked off by cyclone paper vacuum 224 and returned to the main conveyor 208. The third grinding mill 226 reduces the particles down to a size suitable for incineration. Incineration temperatures exceed 2700° F. Surge bin 232 vacuums these grindings up through flue 230 from sweeper 228. Anything remaining on the main conveyor 208 is carried around the loop to the other processing unit 202 or 204.

Figure 3A:
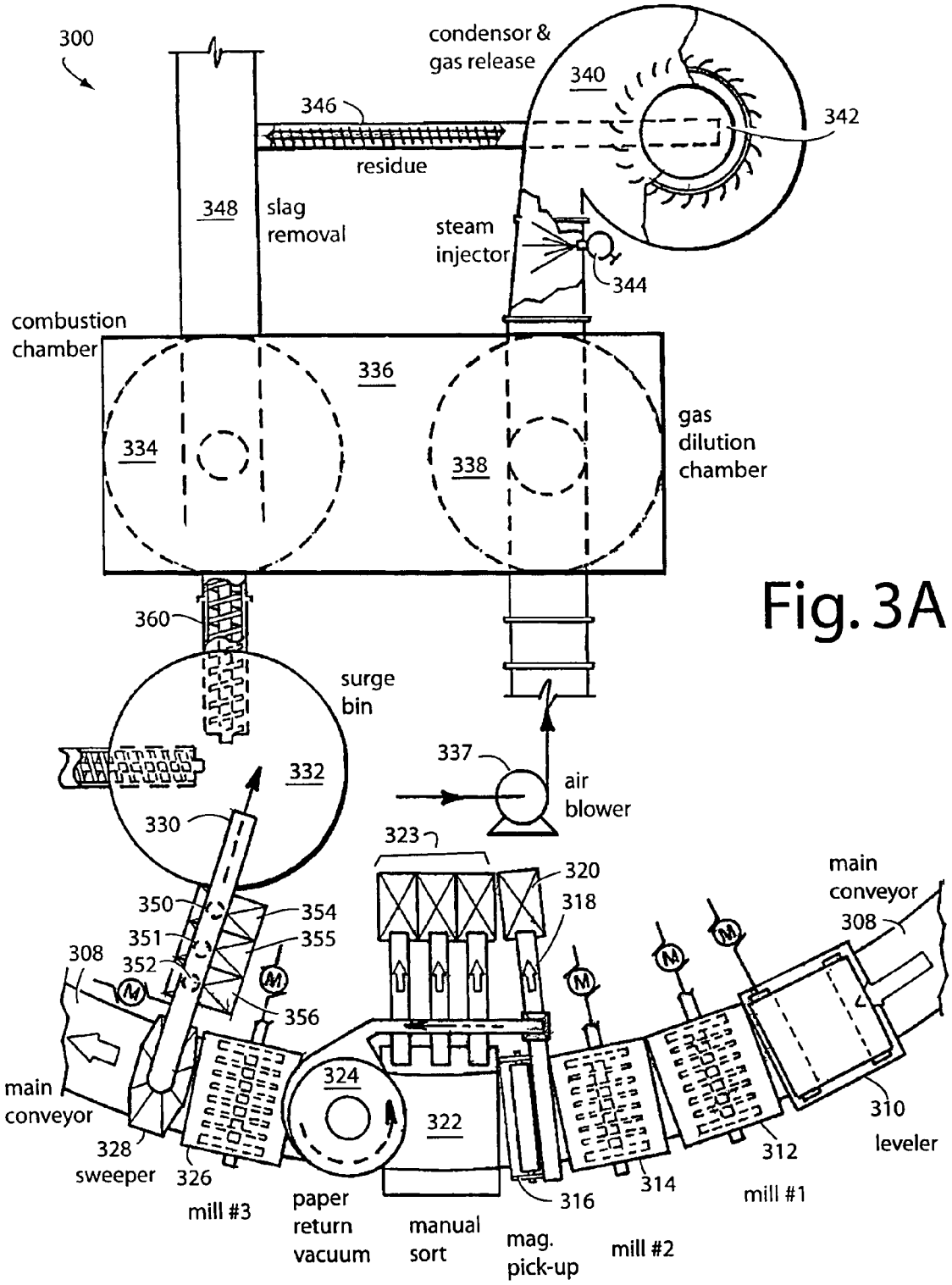
FIG. 3 is a detailed plan view diagram of complete processing portion of a recycling plant embodiment of the present invention which straddles a single, continuous, planar conveyor.
Figure 3B:
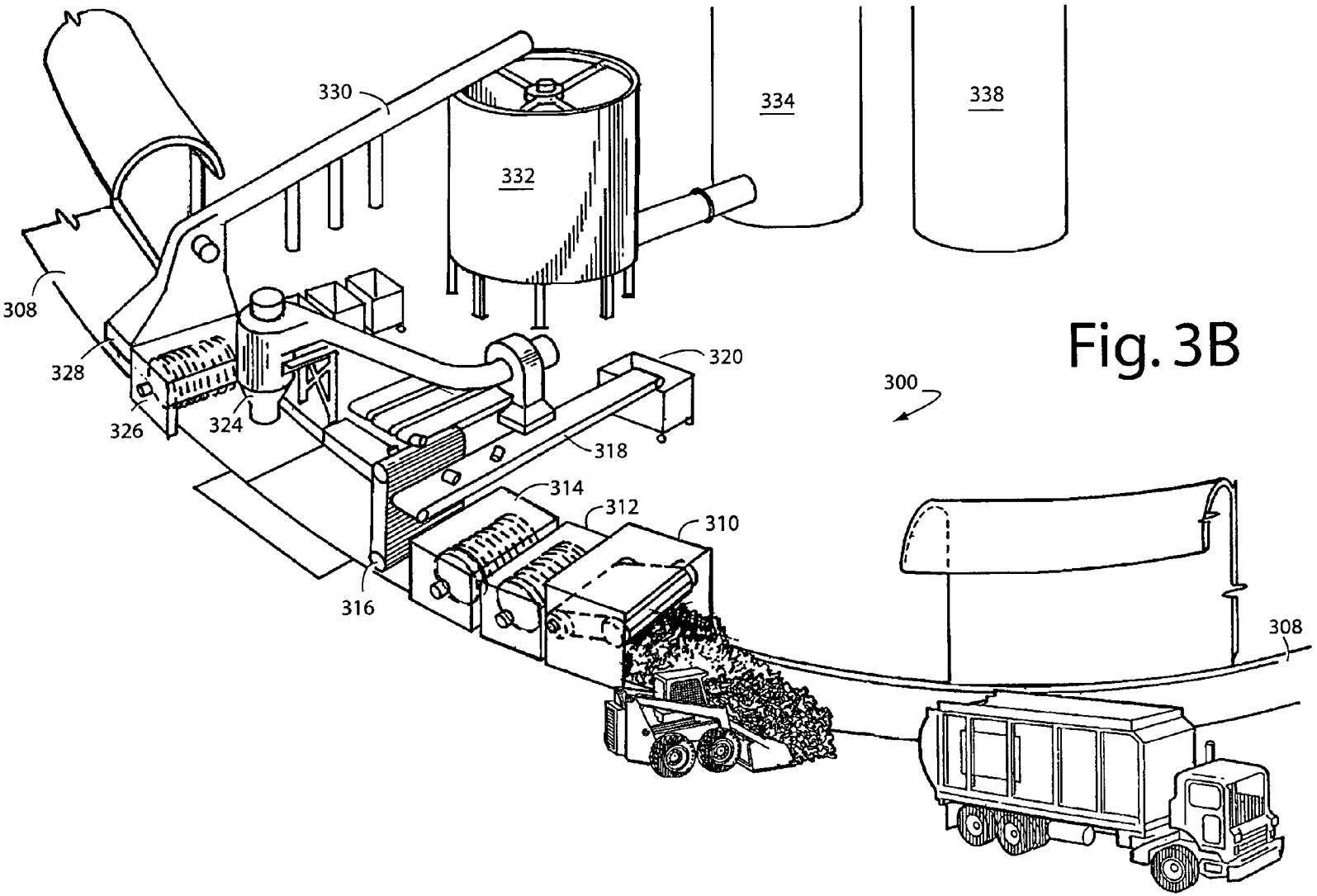

FIGS. 3A and 3B detail one processing unit 300 that is similar to those shown in FIGS. 1-2. Processing unit 300 is shown from above, in plan view in FIG. 3A and in perspective in FIG. 3B. It comprises a main conveyor 308 that brings the mixed refuse from collection into a leveler 310. An overhead conveyor set at an angle and adjustable is used in leveler 310 to press down the mass entering so it can enter a first grinding mill 312. Rotating drums with grinding teeth tear the mixed refuse into small, 4" or less pieces. A second grinding mill 314 reduces this even further to 2" or less. The main conveyor 308 then carries all this under a magnetic pick-up 316 that uses strong electro-magnets to lift up metal containing iron, etc. A takeaway conveyor 318 carries these off to a salvage bin for iron and steel. A manual sorting station 322 allows workers to manually pick through and send glass, plastic, and paper off to respective salvage bins 323. A cyclone vacuum 324 pulls trapped paper from the takeaway conveyor 318 and puts them back on main conveyor 308. A third grinding mill 326 reduces the remaining mass to bits suitable for incineration. A vacuum sweeper 328 sucks these off main conveyor 308 and send it all down a flue 330 to a surge bin 332. Any items too heavy to be vacuumed off main conveyor 308 will remain and be carried on to the next processing unit identical to processing unit 300.

An advantage of arranging processing units like this on a circular conveyor is one can back up the other, and either can be shut down and the plant can still be kept operating pretty much normally.

A combustion chamber 334 has a burner that is used to incinerate the remaining refuse particles brought in by a screw conveyor 360. A hood 336 carries the combustion products over for exhaust gas cleanup. An air blower forces in fresh air to a gas dilution chamber 338 where the lighter combustion products coming over through the hood 336 are diluted.

The combustion exhaust gases are forwarded for steam scrubbing. For example, see U.S. Pat. No. 5,156,819, issued Oct. 20, 1992, to Jody D. Ross. A condensor 340 and exhaust stack 342 are preceded by a high pressure steam injector 344. Any resulting residue that falls out of the gases is carried off in a residue conveyor 346. Similarly, solids in the form of slag that precipitate in the combustion chamber 334 are carried off in a slag drag conveyor 348. Such solids are sterile and useful as fillers in a variety of products.

A series of holes 350-352 are provided in the bottom of flue 330, and these allow heavier items to fall through into bins 354-356. A screw conveyor 360 provides for a carefully metered rate of flow of material to be fed into the combustion chamber to optimize the incineration process. Such rate is adjustable by controlling a drive motor's speed.

Figure 4A:
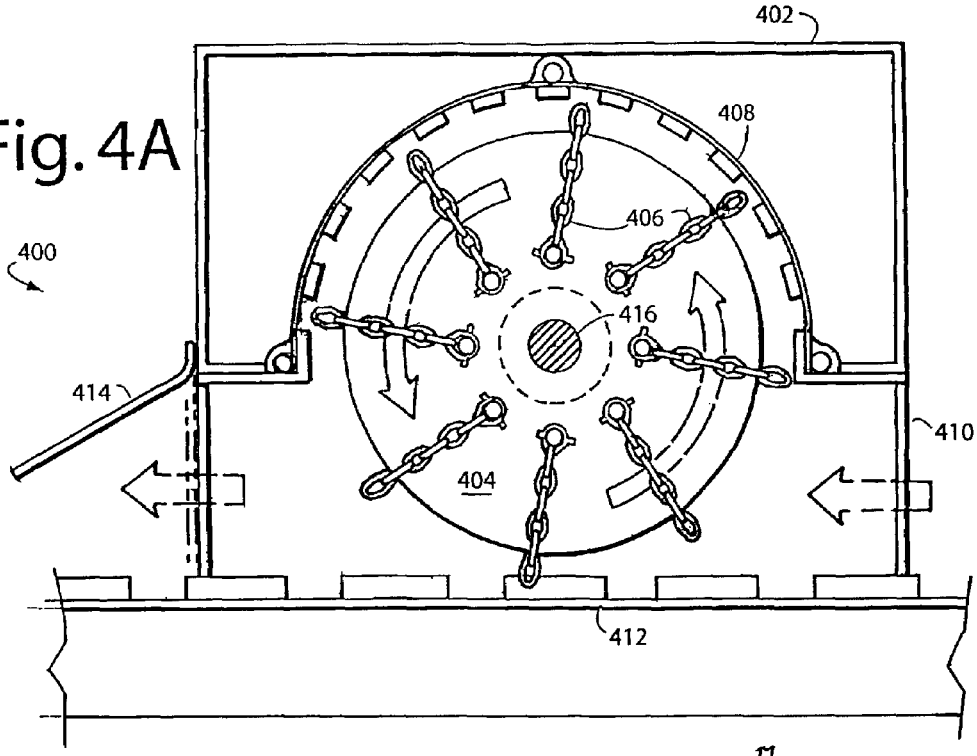
FIGS. 4A and 4B are side view and front view diagrams of the internal operating parts of a chain-type grinding mill embodiment of the present invention useful in the recycling plants of FIGS. 1-3.
Figure 4B:
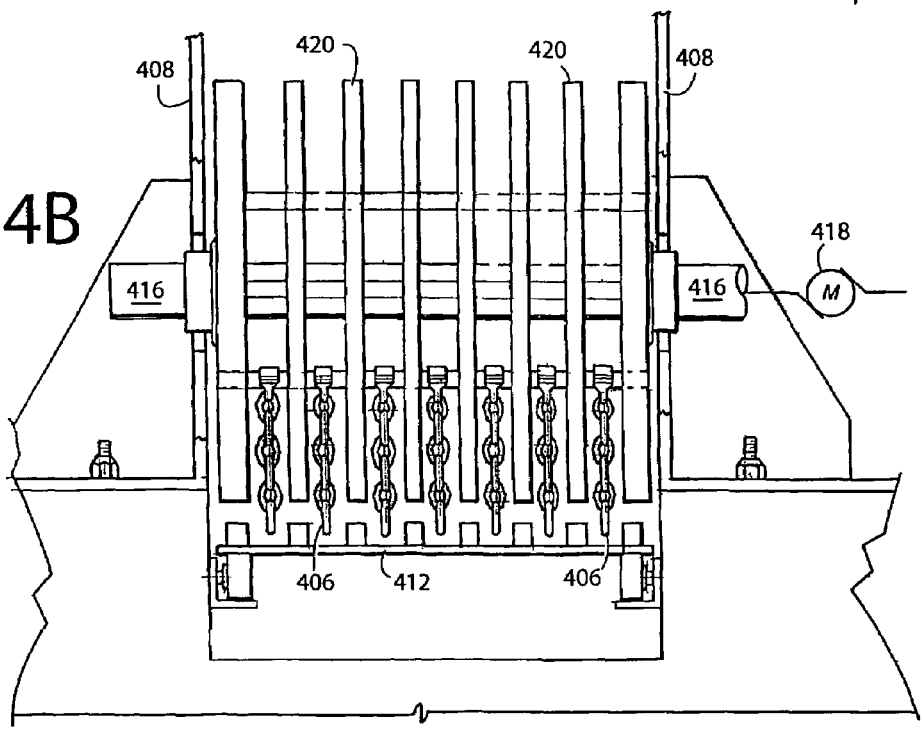

FIGS. 4A and 4B represent a typical grinding mill 400. Each such mill 400 comprises an outer housing 402 inside which spins a counter-rotating drum 404. Several heavy chains 406 are flailed against a circular grating 408 to tear and shred refuse coming in entrance 410 on a main conveyor 412. The flailing chains 406 lift the refuse up and around grate 408 and the pieces fall back on main conveyor 412 and exit through chute 414. The drum 404 is forcefully rotated on a heavy axle 416 by a large electric motor 418. Different grinding sizes, e.g., 4", 2', and 1", can be engineered by changing the overall length, number of links, and weight of chains 406, and the tooth structure and spacing inside grate 408. Discs 420 are used to channel the distal ends of chains 406.

The combustion chambers 134, 234, 334, operate in excess of 2700° F. Incineration produces fly ash and bottom ash, similar to when coal is combusted. The total amount of ash produced by municipal solid waste incineration ranges from 4-10% by volume, and 15-20% by weight of the original quantity of waste. Wikipedia. The fly ash amounts to about 10-20% of the total ash. The fly ash can include lead, cadmium, copper, zinc, and other heavy metals. The bottom ash seldom does, and so is generally considered safe for regular landfill after a testing. Ash, may be considered hazardous, and is usually disposed of in landfills designed to prevent pollutants in the ash from leaching into underground aquifers.

Ash from incineration plants has never been determined to be a hazardous waste. Incineration plants can generate electricity, heat, and steam supply for industrial customers. The bottom ash residue remaining after combustion is a non-hazardous solid waste that can be safely landfilled or reused. Fine particles can be efficiently removed from the flue gases with the condensor 340.

Figure 5A:
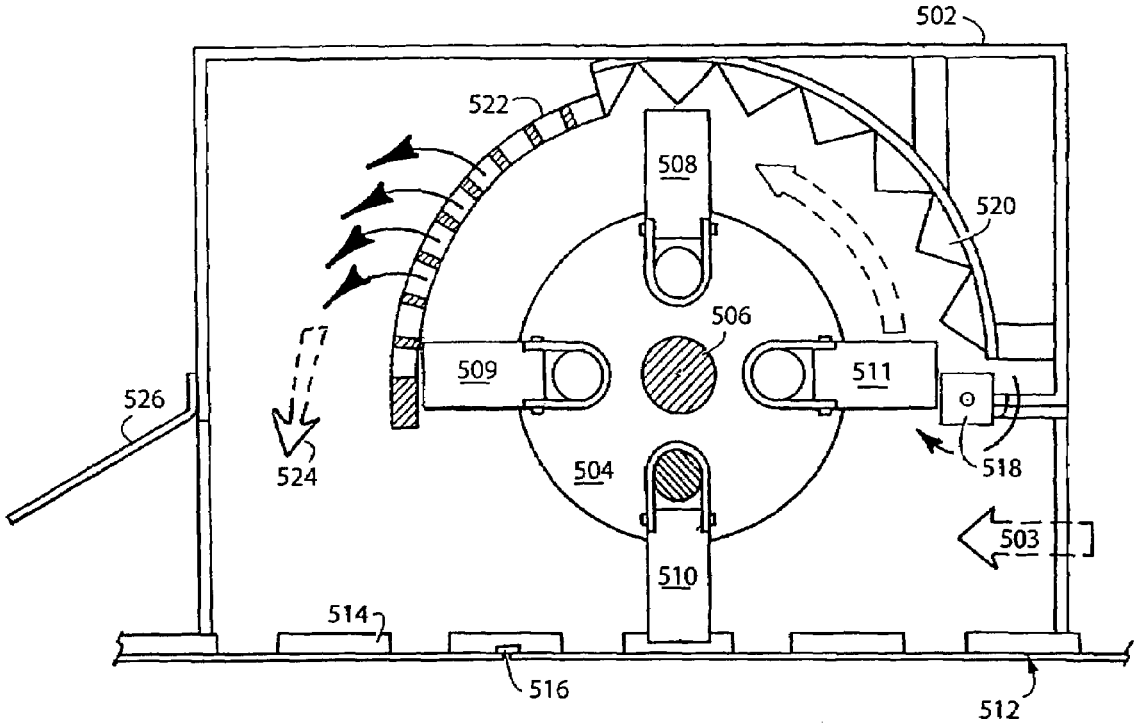
FIG. 5A is a side view diagram of the internal operating parts of a hammer-type grinding mill embodiment of the present invention useful in the recycling plants of FIGS. 1-3.

FIG. 5A represents another type of grinding mill that can be employed, and is referred to herein by the general reference numeral 500. It comprises an outer housing 502 and entrance gate 503. Inside during operation, a drum 504 counter-rotates on a motor-driven axle 506. A number of swing-weights or hammers 508-511 are attached to the drum 504 by link pins and such allows for replaceability of worn or damaged hammers. Refuse is carried in on a main conveyor 512. A series of cleats 514 are aligned with the hammers 508-511 such that the hammers can scoop in between a through formed. A joint 516 represents how individual plates that comprise the main conveyor can be welded together to form a continuous planar belt.

A idler 518 is engaged by the hammers 508-511 as they swing around, and any refuse caught up in the upswing of the hammers is broken and torn by it. A series of teeth 520 interact with hammers 508-511 to further grind and tear at the refuse being tossed around. Openings in a grate 522 will allow ground refuse 524 to pass through and drop back on the main conveyor 512. This is then carried out chute 526.

Figure 5B:
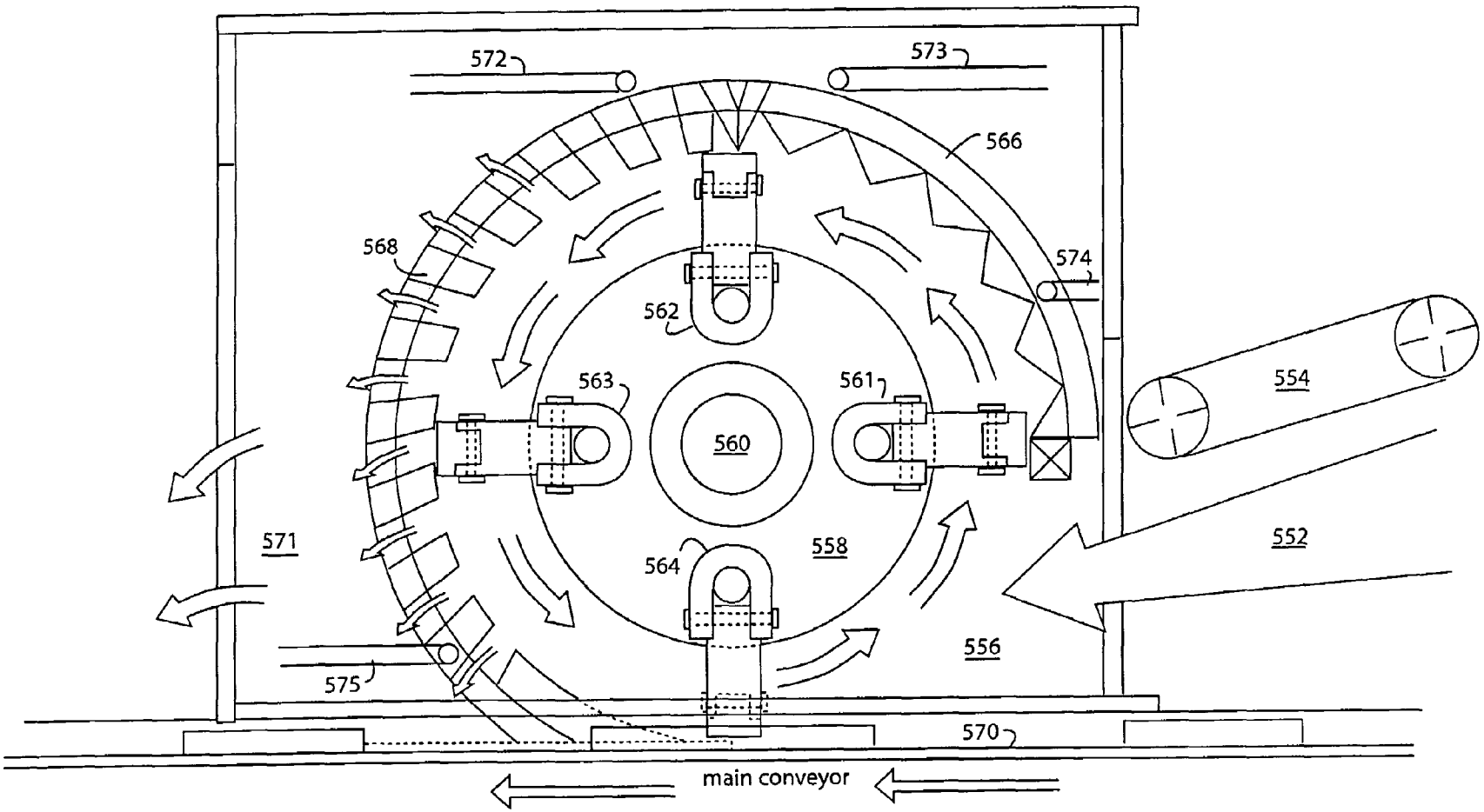
FIG. 5B is a side view diagram of the internal operating parts of an adjustable-grate hammer-type grinding mill embodiment of the present invention also useful in the recycling plants of FIGS. 1-3.

FIG. 5B represents an alternative grinding mill that can be used, and is referred to herein by the general reference numeral 550. It comprises an input flow 552 that is compressed down by a compacting belt 554 into an input area 556. A counter-rotating drum 558 on a horizontal axle 560 flings around grinding hammers 561-564. These each include shoulder pivots, elbow pins, and wrist pins that make replacing worn or damaged pieces easier and more cost effective than that shown in FIG. 5A. The arrangement is rather like a jointed arm. The end pieces, which receive the brunt of the wear, can be reversed to get more use out of what were the trailing edges. A main conveyor 570 brings refuse into input area 556 and carries away the grindings from an output area 571. A set of adjustable supports 572-575 allows a cage comprising grates 566 and 568 to be adjusted according to increasing wear on grinding hammers 561-564.

Figure 6:
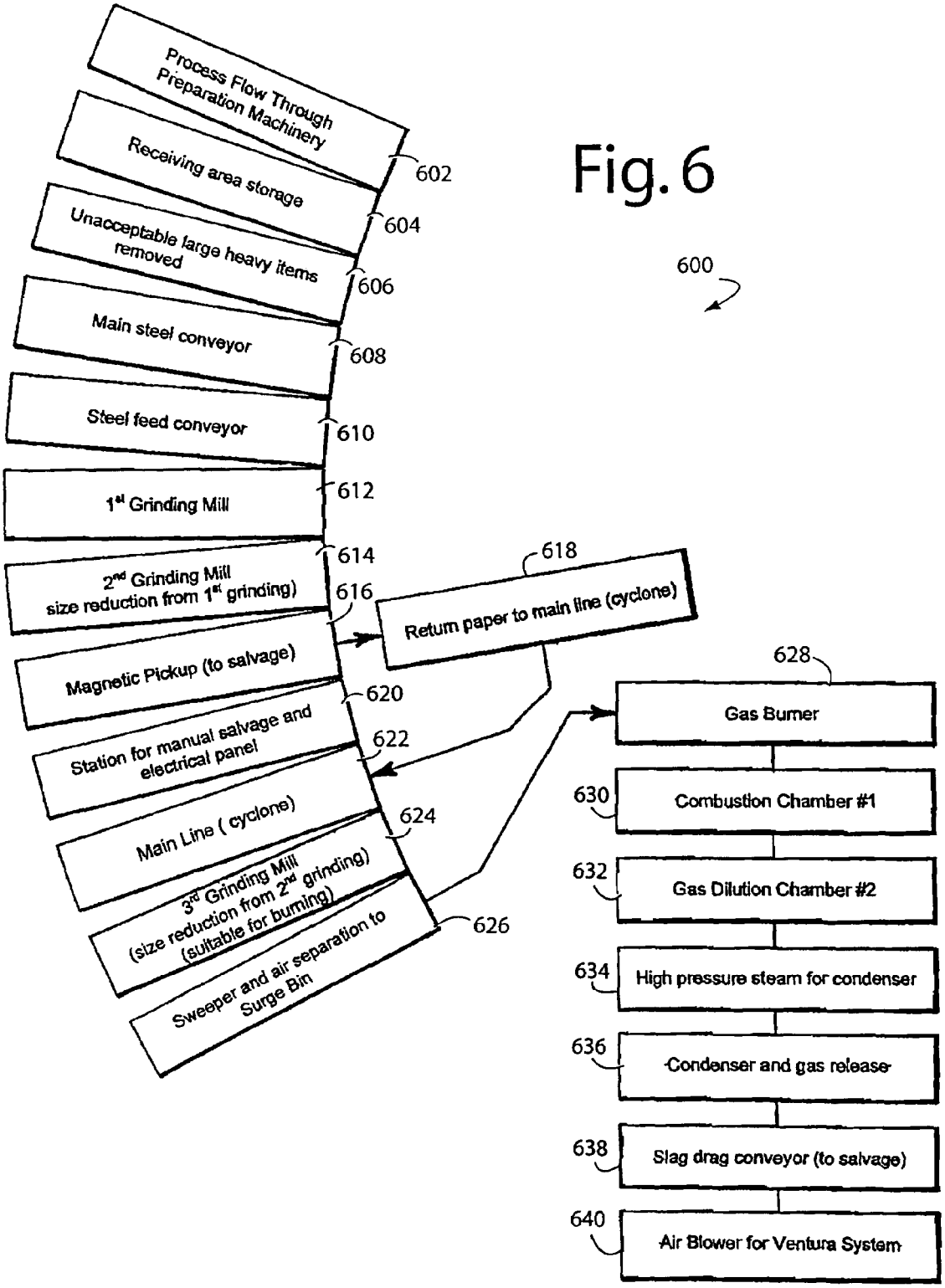
FIG. 6 is a diagram of a method embodiment of the present invention for recycling and reducing refuse waste.

FIG. 6 represents a method 600 in an embodiment of the present invention for recycling and reducing refuse waste. Such method can be employed in the recycling plants of FIGS. 1-3. Method 600 begins with a step 602 for processing a refuse flow through preparation machinery. A step 604 places the prepared material in a receiving area. Unacceptably large items are removed in a step 606. A step 608 uses a continuous main steel conveyor to move the bulk through the system. A steel feed conveyor smashes down and levels the bulk riding on the main conveyor in a step 610. A first grinding mill tears and shreds the material on the main conveyor in a step 612. A second grinding mill reduces the piece sizes in a step 614. A magnetic pickup in a step 616 removes metal parts to salvage. A step 618 returns any paper that may have been caught in the salvage metal parts to the main conveyor. A step 620 uses workers to manually pick and remove recyclable items, e.g., paper, plastic, glass, etc. A step 622 uses a cyclone to return paper to the main line. A step 624 uses a third and last grinding mill to prepare the remaining mass for incineration. A step 626 uses a sweeper and air separation unit to lift and blow light pieces first into a surge bin, and thereafter into a gas burner. Heavy pieces will fall out of the jet flow and drop through bottom holes in the flue to salvage collection bins. A step 628 uses a gas burner to incinerate the air-borne pieces in a combustion chamber step 630 and a gas dilution chamber step 632. A step 634 uses a high pressure steam for a condenser. A step 636 provides for condensing and gas release. A step 638 uses a drag conveyor to collect slag for salvage. And step 640 uses a blower and Venturi system to evacuate the hot gases in the combustion chamber out through a scrubber and its exhaust stacks.

Figure 7A:
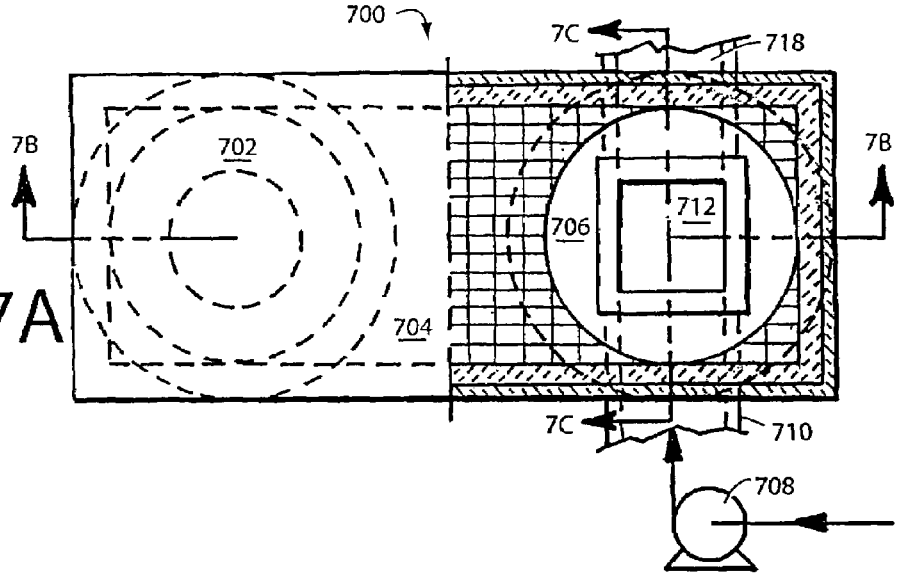
FIGS. 7A-7C are top, side, and end view diagrams of cross sections of an incinerator embodiment of the present invention useful in the recycling plants of FIGS. 1-3.
Figure 7B:
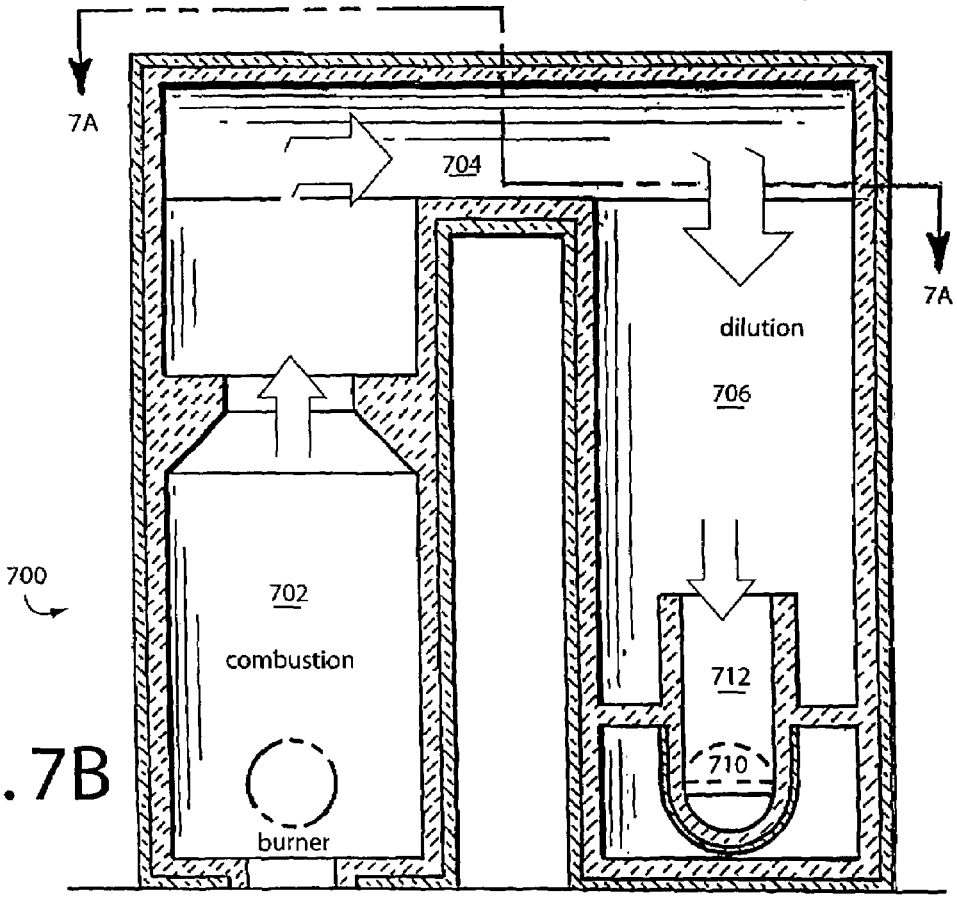
Figure 7C:
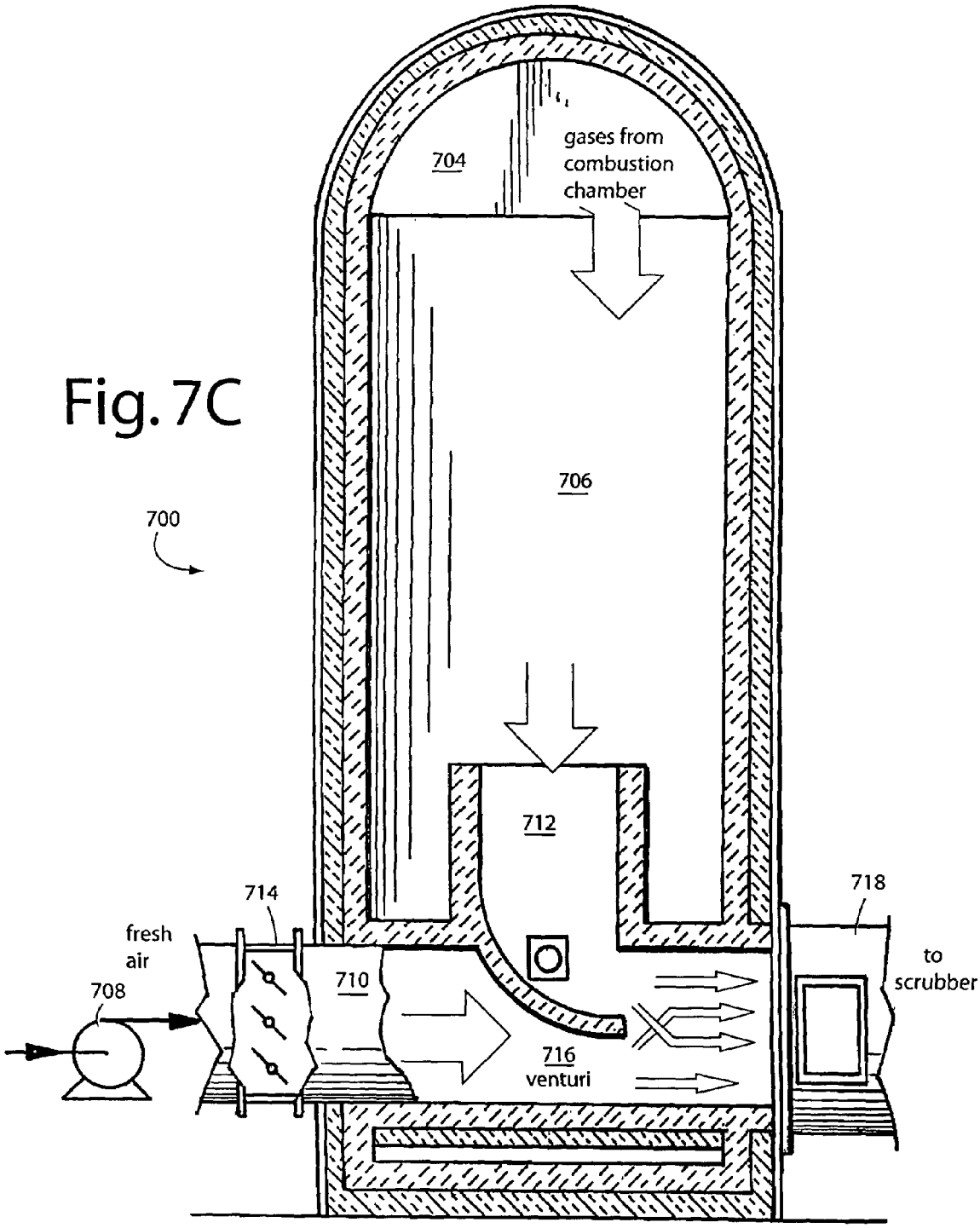

FIGS. 7A, 7B, and 7C represent an incinerator 700 as can be used in the refuse recycling plant of FIGS. 1-3. Incinerator 700 comprises a brick-lined structure with a combustion chamber 702, a crossover flue 704, and a dilution chamber 706. Finely ground refuse is blown into combustion chamber 702 and a burner keeps the temperatures inside in excess of 2700° F. Hot combustion products and gases are carried over through flue 704 to the dilution chamber 706. A blower 708 provides a draw for the hot combustion gases to be exhausted by sending high velocity fresh air in through a port 710. A gas drain 712 sucks the hot gases down and out in proportion to a modulating grille 714 and a Venturi 716. A pipe 718 connects to a scrubber, e.g., condensor 340 and steam injector 344 in FIG. 3. A principle advantage of using the Venturi arrangement best shown in FIG. 7C is the air blower passes only outside temperature air, not the hot gases still cooling down from the 2700° F. combustion process.

A typical incinerator will have steel walls twelve feet in outside diameter. Just inside, there will be seven inches of insulation and a brick lining inside that which is another nine inches thick. The result is a nine foot diameter combustion chamber inside. The screw feed, like conveyor 360 in FIG. 3A, is preferably made of high quality stainless steel construction and turns at a controlled speed to optimize complete combustion.

In one embodiment, a water-filled pit and drag conveyor are placed beneath the combustion chamber 702. Heavy particles and other slag that fall out of the gas suspension drop into the water and are cooled. These drop further down through the water onto the drag conveyor and are removed. The slag produced resembles silica and is sterile. Such can be put to productive use as fillers for cement and asphalt for new construction.

Figure 8:
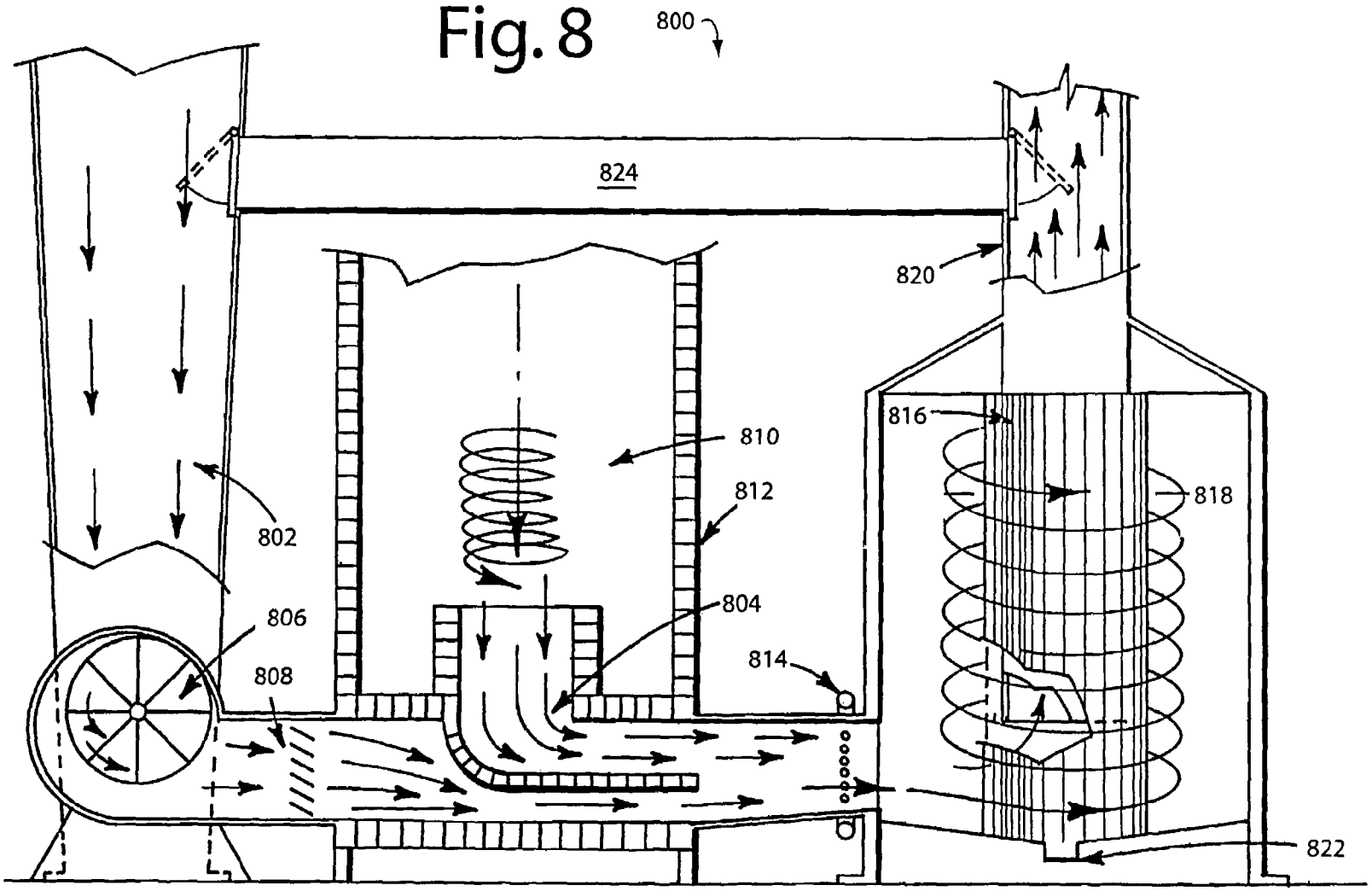
FIG. 8 is a side view diagram of an incinerator subsystem embodiment of the present invention for evacuating hot gases and scrubbing them before their being released to the atmosphere.

FIG. 8 represents an incineration subsystem embodiment of the present invention, and is referred to herein by the general reference numeral 800. The incineration subsystem 800 receives cooler air for use as an exhaust carrier in an input duct 802. Such carrier air is blown into a Venturi 804 by a blower 806 and is modulated by a damper 808. A gas dilution chamber 810 is lined with insulation and brick walls 812 to contain the very high temperatures inside. A steam manifold 814 injects hot vaporized steam for gas scrubbing. Vertical stainless steel condenser louvers 816 are arranged near the center of a vortex 818 to precipitate out heavier particles caught by the steam, and the venting allows only the lighter gases to escape up a chimney stack 820. A centrifugal action that occurs in the vortex 818 also tends to fling the heavier particles of slag outward to the walls, where they drop and pass out through a drain 822. Water condensed from the used steam also flows down out through the drain 822. A bypass 824 is used to recycle some of the exhaust gases.

Such arrangement helps burn the fly ash because the hot gases can be retained longer above the critical temperature of 1700° F. before they are sucked off in the Venturi 804.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A recycling plant, comprising:

a main conveyor to rotate horizontally near ground level, wherein collected mixed refuse can be brought in by trucks on a single-level driveway surrounding the main conveyer;

at least one grinding mill to tear and shred said collected mixed refuse carried in on the main conveyor;

a number of separators to remove and salvage bits of steel, iron, aluminum, plastic, or glass from the main conveyor;

a sweeper to air lift remaining items on the main conveyor for incineration;

an incinerator with a combustion chamber for burning items blown in from the sweeper;

a Venturi arranged to provide a suction draw to evacuate hot gases from said combustion chamber; and a scrubber for treating an exhaust of said hot gases from the Venturi;

wherein, the main conveyor can continue to circulate around again.

2. The recycling plant of claim 1, further comprising:

a second equivalent sequence of grinding mills, separators, sweepers, incinerators, Venturis, and scrubbers on a continuing path of the main conveyor;

wherein a recycling plant can continue substantially normal operation if only one sequence of grinding mills, separators, sweepers, incinerators, Venturis, and scrubbers remains in operation.

3. The recycling plant of claim 1, further comprising:

a perimeter roadway for allowing loaders or dozers to be used to move refuse onto the main conveyer where it can then enter a processing unit straddling the main conveyer.

4. The recycling plant of claim 1, further comprising:

an adjustable height conveyer for riding on top of any heaps of refuse entering on the main conveyor and for compressing the mass so it can enter a first grinding mill.

5. The recycling plant of claim 1, further comprising:

a magnetic pickup with electromagnets to levitate out bits of iron and steel to be carried away and to a salvage bin.

6. The recycling plant of claim 1, further comprising:

a screw feed for carrying material into said combustion chamber from a surge bin.

7. The recycling plant of claim 1, further comprising:

a slag conveyor for removing combustion products that precipitate in the incinerator as hot gases move on to a dilution chamber.

8. The recycling plant of claim 1, further comprising:

an adjustable grate provided in at least grinding mill that allows for the compensation of wear.

* * * * *